United States Patent [19]

Kuboshima

[11] Patent Number: 4,676,388

[45] Date of Patent: Jun. 30, 1987

[54] SAFETY LOCKABLE CONTAINER

[75] Inventor: Yasuyuki Kuboshima, Tokyo, Japan

[73] Assignee: Florex Co., Ltd., Tokyo, Japan

[21] Appl. No.: 867,316

[22] Filed: May 27, 1986

[30] Foreign Application Priority Data

Jun. 4, 1985 [JP] Japan ..... 60-120823

[51] Int. Cl.[4] ..... B65D 85/56; B65D 55/02

[52] U.S. Cl. ..... 215/217; 215/218; 215/225

[58] Field of Search ..... 215/216, 217, 218, 220, 215/223, 224, 225

[56] References Cited

U.S. PATENT DOCUMENTS 4,032,028 6/1977 Reiss et al. ..... 215/223

4,058,232 11/1977 Ohno et al. ..... 215/217

*Primary Examiner*—George T. Hall

*Attorney, Agent, or Firm*—Thomas I. Rozsa

[57] ABSTRACT

A safety lockable container includes a cylindrical container body, an integrally formed outlet nozzle, and a detachable cap. The nozzle has an external thread, which mates with an internal thread on the inner wall of the cap. A plurality of depending claws formed at the bottom of the cap mate in locking engagement with a plurality of corresponding notches in the side wall of the container.

4 Claims, 1 Drawing Figure

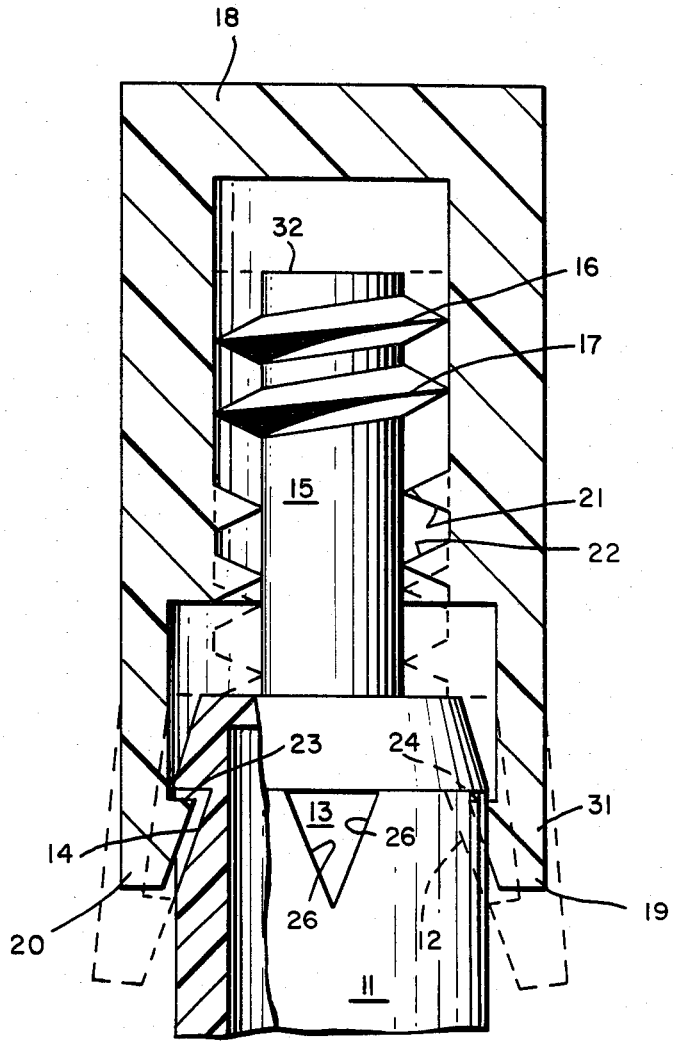
18
32
16
17
15
21
22
23
24
31
13
26
14
26
19
20
12
11

SAFETY LOCKABLE CONTAINER

BACKGROUND OF THE INVENTION

1. Field of the Invention

The present invention relates to a safety lockable container, for glue and the like.

2. Description of the Prior Art

Typically, containers for instantaneous adhesives, drugs or the like are sealed by a threaded cap or snap-fitting cap.

Many products contained in various containers cause injury to a little child when he or she eats or touches the contents. A little child cannot understand the warning labels on the containers, resulting in a very high possibility that he or she may accidentally open the container, eat or touch the contents, and be injured thereby.

Conventional lids or caps, which seal containers, are threadably connected to or fitted over the tops of the containers, but sometimes may be relatively easily removed from the container body, causing a danger when a little child plays with the container.

SUMMARY OF THE INVENTION

It is therefore an object of the present invention to provide a safety lockable container which cannot be accidentally opened.

According to the present invention, the above object is accomplished by providing a safety lockable container comprising a cylindrical container body, a hollow cylinder constituting a passage for a content, and a cap detachably provided over the cylinder to extend up to the fore end of the container body, wherein an external thread is formed on the cylinder, while an internal thread is on the inner wall of the cap to correspond to the external thread on the cylinder, and an inwardly projecting claw is formed on the open end, or depending portion of the cap, while a notch is cut in the fore end of the container body and adapted to be engaged by the claw when the cap is attached.

With the safety lockable container of such a construction, a lock mechanism is constituted of the claw and notch which are engaged with each other when the cap is attached. To remove the cap from the container body, the cap may be pushed toward the container body to release the lock mechanism. Then, the cap is turned to offset the claw from the notch and in this state, the cap is pulled away from the container body to bring the external thread into engagement with the internal thread. Finally, the cap is turned to release the engagement between the external and internal threads and thus, the cap can be removed.

As discussed above, with the safety lockable container according to the present invention, the cap can be simply attached but also cannot be easily removed. Even if a child plays with the container, the cap cannot be released and hence, is safe.

BRIEF DESCRIPTION OF THE DRAWING

The above and other objects, features and advantages of the invention will become apparent from the following description taken in conjunction with the accompanying drawing in which:

The FIGURE is a side elevation, partially in section, of a safety lockable container according to the present invention.

DETAILED DESCRIPTION OF THE INVENTION

The present invention will now be described in more detail by way of a preferred embodiment with reference to the accompanying drawing.

Referring to the FIGURE, there is shown a safety lockable container which includes a bottomed hollow cylindrical container body 11 for containing a content (not shown) therein. A nozzle 15, which may be the hollow cylindrical nozzle illustrated in the FIGURE, is integrally formed on the fore end of the container body 11 in communication with the interior of the body 11 to define a passage for the access of the content into and out of the container body 11.

A plurality of, for example, two or four notches 12, 13 and 14 (three notches are shown in the FIGURE), are cut in the peripheral wall of the container body 11 at places slightly apart from the fore end of the body 11. Each notch 12, 13, 14 is triangular, with one side parallel to the fore end surface of the container body 11 as most clearly illustrated by notch 13. An apex of each triangle points directly down. Each triangular notch 12, 13, 14 is indented into the side wall of Container 11, with the top edge of the each notch being most deeply indented, and the triangular plane of each notch 12, 13, 14 tapering outwardly to the downwardly facing apex, which is flush with the side wall of Container 11. The triangular surface is inclined downwardly toward the aft end of the container body 11, as seen by the reference characters 12 and 14. Consequently, vertical wall surfaces 23, 24, and 26 are formed between the triangular surfaces of the notches and the peripheral wall of the container body, respectively, which prevent rotation of Cap 18. The nozzle 15 has external threads 16 and 17 formed at its fore end.

A bottomed cylindrical cap 18 is detachably attached over the entire nozzle 15, which is an integrally formed portion of container body 11, and whose interior communicates with container body 11, and the upper portion of the container body 11. Cylindrical cap 18 has internal threads 21 and 22 formed thereon to correspond to the external threads 16 and 17 on nozzle 15 and adapted to mesh with them.

The open end of cap 18 has an inner diameter slightly larger than the outer diameter of the container body 11 constituting a thinned portion 31 which can be yieldingly deformed during opening and closing of the container. The same number of claws 19 and 20 (two notches are shown in the FIGURE) as the number of notches 12, 13, and 14 made in the container body 11 are formed on the depending extremity of the cap 18 to project inwardly. Claws 19 and 20 are shaped to engage the notches 12 and 14 for constituting a locking mechanism.

The internal depth of the cap 18 from the claws 19 and 20 to the closed end thereof is such that, when the cap 18 is pushed over the container body to allow the inner closed-end surface of the cap 18 to abut against the outer surface at fore end 32 of the nozzle 15, the engagement of the claws 19 and 20 with the notches 12 and 14 is released. In addition, the distance between the claws 19 and 20 is advantageously greater than the diameter of external threads 16, 17 of nozzle 15.

It is to be noted that the entire cap 18 can be formed of a hard plastic or the like. The container may advantageously be made of the same material. Any convenient material may be used, as is well known in the art.

Alternatively, the number of the claws may be different from the number of notches but in such a case, must be less than the number of notches.

With the safety lockable container according to the preferred embodiment of the present invention, in a normal covering of the container with the cap 18, the claws 19 and 20 of the cap are in engagement with the notches 12 and 14, so that the locking mechanism is engaged, preventing accidental removal of the cap from the container. In this state, even if one intends to remove the cap 18 without manipulating the cap and bottle in a precise manner described below, it cannot be removed from the container.

When the cap 18 is desired to be removed, the cap 18 is first pushed further toward the container to bring inner surface 18*a* of the closed end of the cap 18 into abutment against the fore end surface of the nozzle 15. In so doing, the claws are disengaged from the notches 12 and 14, and the thinned portion of the cap 18 is expanded due to its plasticity as the extremities of the claws 19 and 20 are pushed onto the flat peripheral surface of the container body 11.

When the claws 19 and 20 disengaged from the notches 12 and 14 as described above, the cap 18 is rotated or turned to deflect the claws 19 and 20 from the notches 12 and 14. Then, the cap 18 is pulled away from the container in this state, so that the internal threads 21 and 22 mesh with the external threads 16 and 17. Then, cap 18 is turned and pulled away from the container body 11 and thus, the cap 18 is removed.

Of course, the present invention is not intended to be restricted to any particular form or arrangement, or any specific embodiment disclosed herein, or any specific use, since it may be modified in various particulars without departing from the spirit or scope of the claimed invention shown and described herein, of which the apparatus shown is intended only for illustration and for disclosure of an operative embodiment and not to show all of the various forms or modifications which might embody the invention.

The invention has been described in considerable detail to comply with the patent laws by providing a full public disclosure of the best mode contemplated by the inventor for practicing his invention. Such detailed description is not, however, intended in any way to limit the broad features or principles of the invention, or the scope of the patent property to be granted.

What is claimed is:

1. A safety lockable container comprising:

a. a container body having an upward extending integrally formed hollow nozzle having at least one thread on its exterior surface;

b. at least one notch in said container body near the fore end of said container body; and c. a removable cap comprising a hollow cylindrical body having at least one depending inwardly projecting claw adapted for engaging said notch and at least one thread on the inner wall of said cap adapted for threadably engaging said thread on said nozzle.

2. A container in accordance with claim 1 wherein said cap further comprises a flexible cap whereby depressing said cap firmly against said container causes said depending claw to spring free of engagement with said notch, permitting rotating removal of said cap from said container.

3. A container in accordance with claim 1 wherein said container further comprises:

a. three said notches in said container body, said notches being equally spaced about the perimeter of said container; and b. three said depending claws spaced equally about the circumference of the lower portion of said cap.

4. A container in accordance with claim 1 wherein the number of said depending claws is less than the number of said notches.

* * * * *